US006342868B1

(12) United States Patent
Tsai et al.

(10) Patent No.: US 6,342,868 B1
(45) Date of Patent: Jan. 29, 2002

(54) STRIPLINE PCB DIPOLE ANTENNA

(75) Inventors: Szu-Nan Tsai; Hsiang-Hui Shen; Hsin-Kuo Dai; Kun-Te Cheng; Hsien-Chu Lin; Chieh-Chao Yu; Chih-Kai Huang, all of Tu-Chen (TW)

(73) Assignee: Hon Hai Precision Ind. Co,. Ltd., Taipei Hsien (TW)

( * ) Notice: Subject to any disclaimer, the term of this patent is extended or adjusted under 35 U.S.C. 154(b) by 0 days.

(21) Appl. No.: 09/800,232

(22) Filed: Mar. 5, 2001

(30) Foreign Application Priority Data

Dec. 30, 2000 (TW) ..... 089128439

(51) Int. Cl.[7] ..... H01Q 9/28
(52) U.S. Cl. ..... 343/795; 343/700 MS
(58) Field of Search ..... 343/700 MS, 795, 343/727, 793, 810, 803, 806

(56) References Cited

U.S. PATENT DOCUMENTS 5,293,175 A * 3/1994 Hemmie et al. ..... 343/795
5,523,768 A * 6/1996 Hemmie et al. ..... 343/840
5,719,586 A * 2/1998 Tuttle ..... 343/726
5,754,145 A * 5/1998 Evans ..... 343/795
6,014,112 A * 1/2000 Koscica et al. ..... 343/795
6,037,911 A * 3/2000 Brankovic et al. ..... 343/795

* cited by examiner

*Primary Examiner*—Tan Ho
(74) *Attorney, Agent, or Firm*—Wei Te Chung

(57) ABSTRACT

A stripline PCB dipole antenna for use in an electronic device includes a substrate (3), a first dipole antenna (1), a second dipole antenna (2), a first feeder apparatus (41), and a second feeder apparatus (42). The first and second dipole antennas are generally T-shaped, are disposed on opposite surfaces of the substrate, are perpendicular to each other, and are fed through the first and second feeder apparatuses respectively. The first and second feeder apparatuses feed the antennas near respective edges of the substrate, to reduce any adverse influences that their wiring paths may have on the stripline PCB dipole antenna. The stripline PCB dipole antenna utilizes a switch mechanism of dual polarized radiation to switch between two of the three radiation planes, namely the XY-plane, the XZ-plane and the YZ-plane. The stripline PCB dipole antenna thus achieves optimum diversity reception efficiency under the control of an external device.

21 Claims, 2 Drawing Sheets

| 1:Mkr (MHz) | | 2:Mkr (MHz) dB |
|---|---|---|
| A: 2400.0000 | 1.435 | |
| B: 2450.0000 | 1.401 | |
| C> 2500.0000 | 1.599 | |

STRIPLINE PCB DIPOLE ANTENNA

BACKGROUND OF THE INVENTION

1. Field of the Invention

The present invention relates to a stripline PCB dipole antenna, and more particularly to a dual-fed co-planar stripline PCB dipole antenna used in an electronic device for receiving and/or transmitting electromagnetic signals.

2. Related Art

In the communications field, dipole antennas have been widely used for a long time for effectively receiving and transmitting electromagnetic signals. Most electronic devices use single dipole antennas. Conventionally, a single dipole antenna has three radiation planes, namely an XY-plane, an XZ-plane and a YZ-plane. Generally, only one of these radiation planes has preferred radiation efficiency, and the other radiation planes are disregarded. Moreover, a feeding device of a conventional single dipole antenna is complex and occupies a lot of space.

An antenna disclosed in U.S. Pat. No. 4,605,931 utilizes a crossover feeding system. The system comprises pairs of a first feeder apparatus and a second feeder apparatus, one feeder apparatus crossing over the other. Each pair of the crossed first and second feeder apparatuses has a first port and a second port for transmitting a first signal therebetween, and a third port and a fourth port for transmitting a second signal therebetween. The system reduces interaction between signals, and eliminates back feeding of signals. However, the system is too complex to be practically implemented.

Taiwan Patent Application No. 87112281 discloses a circular polarized microstrip antenna that has a short adjustable metal microchip on an edge of a fixed metal microchip. A feed point of the microstrip antenna is on the short adjustable metal microchip or a cross-line thereof which is oriented at 45°. The metal microchip is installed on a grounding plane. The microstrip antenna has preferred radiation efficiency in the XZ-plane and the YZ-plane. However, the microstrip antenna is also very complex. It requires a large space, and cannot be easily integrated into communications equipment.

Other antennas are disclosed in U.S. Pats. Nos. 4,069,483 and 6,091,366. They all utilize only one of the three radiation planes to provide radiation efficiency.

SUMMARY OF THE INVENTION

An object of the present invention is to provide a stripline PCB dipole antenna capable of switching between two of the three radiation planes, namely the XY-plane, the XZ-plane and the YZ-plane, to achieve optimum diversity reception efficiency.

Another object of the present invention is to provide a stripline PCB dipole antenna which reduces any adverse influences that wiring paths of feeder RF cables may have on the characteristics of the antenna.

A further object of the present invention is to provide a feeding method whereby two dipole antennas are fed through feed patches to make full use of two of the three radiation planes and thereby provide optimum diversity reception efficiency.

To achieve the above-mentioned objects, a stripline PCB dipole antenna in accordance with the present invention for placing in an electronic device includes a substrate, a T-shaped first dipole antenna disposed on a surface of the substrate, a T-shaped second dipole antenna disposed on an opposite surface of the substrate and perpendicular to the first dipole antenna, and first and second feeder apparatuses feeding the antennas near respective edges of the substrate. The positioning of the feeder apparatuses reduces any adverse influences that the wiring paths of the feeder apparatuses may have on the characteristics of the stripline PCB dipole antenna.

The stripline PCB dipole antenna utilizes a switch mechanism of dual polarized radiation to switch between two of the three radiation planes, namely the XY-plane, the XZ-plane and the YZ-plane. The stripline PCB dipole antenna thus achieves optimum diversity reception efficiency under the control of an external device.

These and additional objects, features and advantages of the present invention will become apparent after reading the following detailed description of a preferred embodiment of the invention taken in conjunction with the appended drawings.

DETAILED DESCRIPTION OF THE INVENTION

Figure 1:
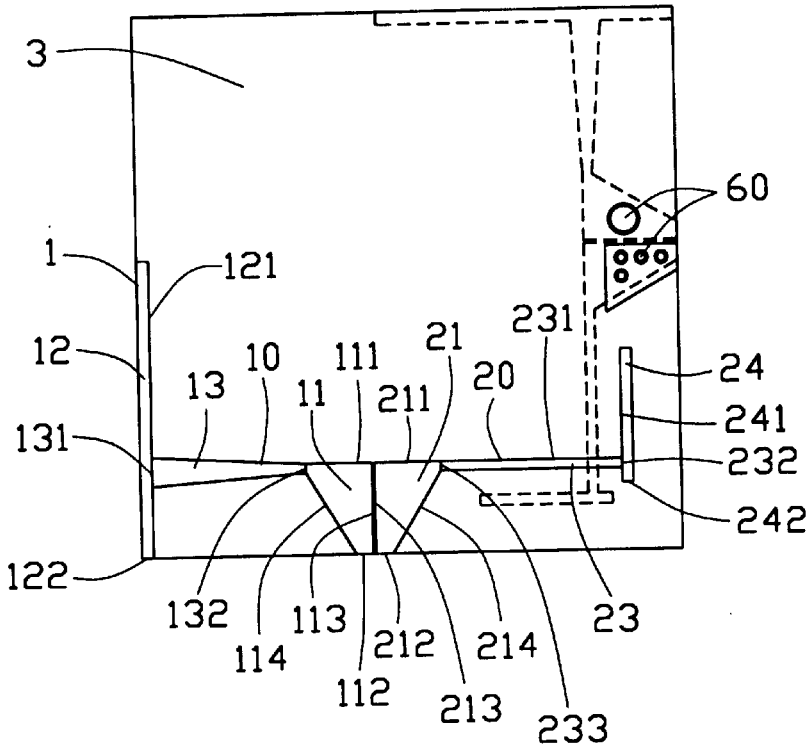
FIG. 1 is a plan view of a stripline PCB dipole antenna in accordance with the present invention.

Referring to FIG. 1, a stripline PCB dipole antenna in accordance with the present invention includes a substrate 3, a first dipole antenna 1, a second dipole antenna 2, a first feeder apparatus 41 and a second feeder apparatus 42.

The first and second dipole antennas 1, 2 are generally T-shaped, and have substantially the same structure, shape and size. The first dipole antenna 1 is disposed on a first surface 31 of the substrate 3, and the second dipole antenna 2 is disposed on a second surface 32 of the substrate 3 which is opposite to the first surface 31. The first and second dipole antennas 1, 2 are generally perpendicular to each other. Each first and second dipole antenna 1, 2 includes a first dipole cell 10 and a second dipole cell 20.

In the preferred embodiment of the invention, the first dipole cell 10 is an integrated patch including a first feed patch 11, a first arm 12 and a second arm 13. As shown in FIG. 1, the first feed patch 11 is generally shaped as a right-angled trapezoid. The first feed patch 11 has a first lower edge 111, a first upper edge 112, a first facing edge 113, and a first bevel edge 114. The first arm 12 is rectangular, and has a first long edge 121 and a first short edge 122. The first long edge 121 is parallel with the first facing edge 113 of the first feed patch 11. The first short edge 122 is parallel with the first upper and lower edges 112, 111 of the first feed patch 11. The second arm 13 is shaped as an isosceles trapezoid, and has an upper side 132 and a lower side 131. The lower side 131 is connected with the first long edge 121 of the first arm 12. The upper side 132 is connected with an edge (not labeled) of the first feed patch 11 which is between the first bevel edge 114 and the first lower edge 111.

The second dipole cell 20 is an integrated patch including a second feed patch 21, a third arm 23 and a fourth arm 24. The second feed patch 21 is substantially the same size as the first feed patch 11 of the first dipole cell 10, and is disposed symmetrically opposite to the first feed patch 11. A space (not labeled) exists between the first and second feed patches 11, 21. The second feed patch 21 has a second lower edge 211, a second upper edge 212, a second facing edge 213, and a second bevel edge 214. The second lower edge 211 is collinear with the first lower edge 111 of the first dipole cell 10. The third and fourth arms 23, 24 are both rectangular. The third arm 23 has a third long edge 231, a third short edge 232, and a fourth short edge 233. The fourth arm 24 has a second long edge 241, and a second short edge 232. The second long edge 241 of the fourth arm 24 is parallel with the first long edge 121 of the first arm 11. The second short edge 242 of the fourth arm 24 is parallel with the first lower edge 111 of the first arm 11. The third long edge 231 of the third arm 23 and the second lower edge 211 of the second feed patch 21 are collinear. The fourth short edge 233 of the third arm 23 is connected with the second long edge 241 of the fourth arm 24. The third short edge 232 of the third arm 23 is connected with an edge (not labeled) of the second feed patch 21 which is between the second bevel edge 214 and the second lower edge 211.

Figure 2:
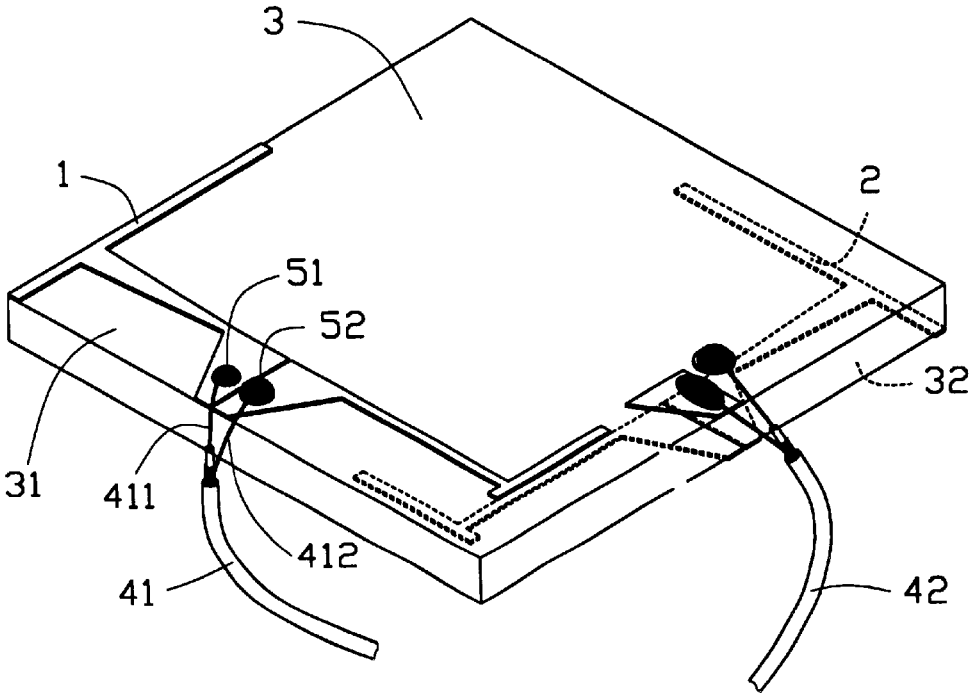
FIG. 2 is a perspective view of the stripline PCB dipole antenna of FIG. 1.

As shown in FIG. 2, each first and second feed patch 11, 21 respectively has a feed point 51, 52 defined thereon.

The first and the second dipole antennas 1, 2 are respectively fed through the first and second feeder apparatuses 41, 42. In the preferred embodiment of the invention, the first and second feeder apparatuses 41, 42 are coaxial RF cables which each include a signal line and a ground line. A signal line 411 and a ground line 412 of the first feeder apparatus 41 are respectively connected with the first feed patch 11 and the second feed patch 21 by welding to the feed points 51 and 52 respectively. The second feeder apparatus 42 is also welded on the first surface 31 of the substrate 3. The second feeder apparatus 42 is connected with feed patches of the second dipole antenna 2 on the second surface 32 of the substrate 3 via through holes 60 (shown in FIG. 1).

The first and second feed patches 11, 21 of the first and the second dipole antennas 1, 2 are located near edges of the substrate 3, so that the first and the second dipole antennas 1, 2 can be fed from sides of the substrate 3. This reduces any adverse influences that the wiring paths of the feeder apparatuses 41, 42 may have on the characteristics of the stripline PCB dipole antenna.

Voltage Standing Wave Ratio (VSWR) is a standard criterion used in measuring antenna characteristics in a given frequency range. In general, a VSWR greater than 1.0 is considered reasonable in the communications field. In addition, prevailing industry standards of antenna design dictate that for a given frequency range, a VSWR less than 2.0 is required for effective operation.

Figure 3:
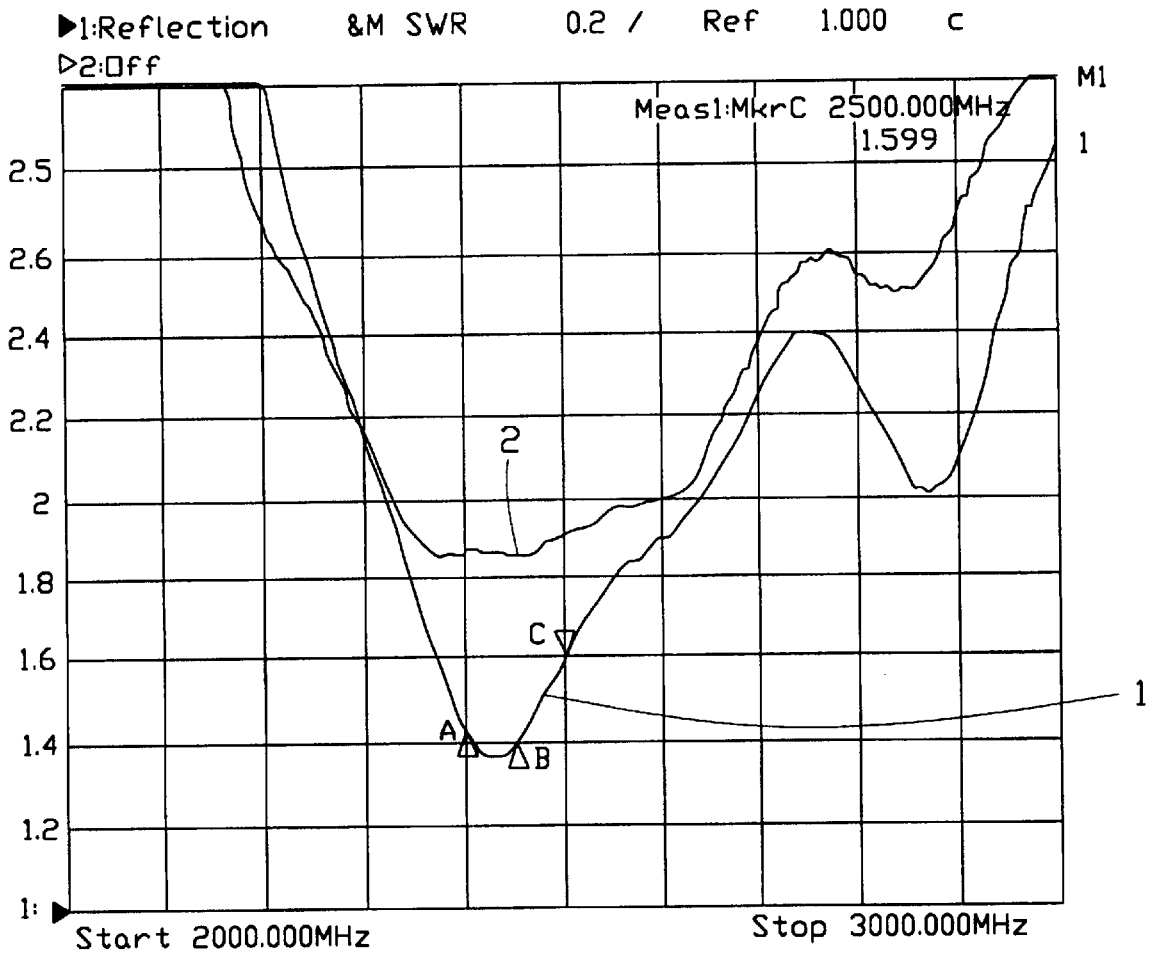
FIG. 3 is a graph of experimental results for the stripline PCB dipole antenna of FIG. 1.

FIG. 3 is a graph of experimental results for the stripline PCB dipole antenna, showing VSWR varying with frequency. The results show that the VSWR of each of the first and second dipole antennas 1, 2 is less than 2.0 in the frequency range of 2.4–2.5 GHz. These results comply with industry-standard antenna design specifications.

The stripline PCB dipole antenna according to the present invention which includes the first and second dipole antennas 1, 2 placed on the same substrate 3 and perpendicular to each other can utilize a switch mechanism of dual polarized radiation to switch between two of the three radiation planes, namely the XY-plane, the XZ-plane and the YZ-plane. The switch mechanism can be controlled by an external device. The stripline PCB dipole antenna thus achieves optimum diversity reception efficiency.

In summary, the stripline PCB dipole antenna of the present invention overcomes the problems of conventional technology and achieves better efficiency for receiving and/or transmitting electromagnetic signals. While the present invention has been described with reference to a specific embodiment thereof, the description is illustrative and is not to be construed as limiting the invention. Various modifications to the present invention may be made to the preferred embodiment by those skilled in the art without departing from the true spirit and scope of the invention as defined by the appended claims.

We claim:

1. A stripline dipole antenna for receiving and/or transmitting electromagnetic signals, comprising:

a substrate having a first surface and an opposite second surface;

a first dipole antenna and a second dipole antenna respectively disposed on the first and the second surfaces of the substrate and substantially perpendicular to each other; and a first feeder apparatus and a second feeder apparatus through which the first and the second dipole antennas are fed, respectively.

2. The stripline dipole antenna as claimed in claim 1, wherein each first and second dipole antenna is generally T-shaped.

3. The stripline dipole antenna as claimed in claim 1, wherein each first and second dipole antenna has two dipole cells.

4. The stripline dipole antenna as claimed in claim 3, wherein one of the two dipole cells is an integrated patch comprising a first feed patch, a first arm and a second arm, and the other dipole cell is a integrated patch comprising a second feed patch, a third arm and a fourth arm.

5. The stripline dipole antenna as claimed in claim 4, wherein the first arm and the second arm are arranged together to form a generally T-shaped configuration, and the third arm and the fourth arm are arranged together to form a generally T-shaped configuration.

6. The stripline dipole antenna as claimed in claim 4, wherein one end of the second arm is connected with the first arm, and one end of the third arm is connected with the fourth arm.

7. The stripline dipole antenna as claimed in claim 6, wherein the first and the second feed patches are respectively positioned at the other end of the second arm and at the other end of the third arm.

8. The stripline dipole antenna as claimed in claim 4, wherein each first and second feed patch has a feed point.

9. The stripline dipole antenna as claimed in claim 8, wherein the first feeder apparatus is connected with the first and the second patches of the first dipole antenna through the two feed points.

10. The stripline dipole antenna as claimed in claim 1, wherein the first and second feeder apparatuses are coaxial RF cables.

11. The stripline dipole antenna as claimed in claim 1, wherein the first feeder apparatus is welded on the first surface of the substrate for connection with the first dipole antenna.

12. The stripline dipole antenna as claimed in claim 1, wherein the second feeder apparatus is welded on the first surface of the substrate for connection with the second dipole antenna on the second surface of substrate.

13. The stripline dipole antenna as claimed in claim 1, wherein at least one of the first and second feeder apparatuses is fed at a respective edge of the substrate.

14. A method for feeding a stripline dipole antenna, comprising the following steps:

(1) providing a substrate having a first surface and an opposite second surface;

(2) placing a first dipole antenna and a second dipole antenna, each first and second dipole antenna comprising two feed patches, on the first and the second surfaces of the substrate respectively;

(3) providing a first coaxial RF cable and a second coaxial RF cable, each first and second coaxial RF cable comprising a signal line and a ground line; and (4) connecting each first and second coaxial RF cable with the corresponding first and second dipole antenna respectively through the corresponding feed patches, to feed the first and second dipole antennas.

15. The method as claimed in claim 14, wherein each dipole antenna comprises two co-planar dipole cells.

16. The method as claimed in claim 14, wherein step (4) further comprises welding one of the signal line and the ground line of the first coaxial RF cable to one of the two feed patches of the first dipole antenna.

17. The method as claimed in claim 14, wherein step (4) further comprises welding the second coaxial RF cable on the first surface of the substrate, and connecting the second coaxial RF cable to the second dipole antenna on the second surface of the substrate.

18. The method as claimed in claim 14, wherein step (4) further comprises welding at least one of the first and second coaxial RF cables to the substrate at a respective edge of the substrate.

19. A dipole antenna for receiving and/or transmitting electromagnetic signals, comprising:

a substrate defining opposite first and second surfaces;

first and second dipole antennas mounted on the first and second surfaces, respectively;

first and second feeder apparatuses respectively connected to the first and second dipole antennas;

each of said first dipole antennas including two cells;

each of said feeder apparatuses including a signal line and a ground line, electrically and mechanically connected to the corresponding two cells of the corresponding dipole antenna, respectively; wherein both the first and second feeder apparatus are directly soldered on the first surface while the second feeder apparatus is further electrically connected to the corresponding second dipole antenna via through holes of the substrate which are defined between the first surface and the second surface.

20. A dipole antenna for receiving and/or transmitting electromagnetic signals, comprising:

a substrate defining opposite first and second surfaces;

first and second dipole antennas mounted on the first and second surfaces, respectively;

first and second feeder apparatuses respectively connected to the first and second dipole antennas;

each of said first dipole antennas including two cells;

each of said feeder apparatuses including a signal line and a ground line, electrically and mechanically connected to the corresponding two cells of the corresponding dipole antenna, respectively; wherein a connection portion of the feeder apparatus and the corresponding dipole antenna is located closer to an edge of the substrate rather than to a center portion thereof.

21. The antenna as claimed in claim 20, wherein the edge of the substrate adjacent to which the connection portion of the first dipole antenna and the corresponding first feeder apparatus is mounted, is different from the edge adjacent to which the connection portion of the second dipole antenna and the corresponding second feeder apparatus is mounted.

* * * * *